US008098126B2

(12) United States Patent
Niedzwiecki et al.

(10) Patent No.: US 8,098,126 B2
(45) Date of Patent: Jan. 17, 2012

(54) HIGH VOLTAGE SERVICE DISCONNECT ASSEMBLY

(75) Inventors: Mark Niedzwiecki, Troy, MI (US); William Lyons, West Bloomfield, MI (US); Andrew S. Fisher, Ortonville, MI (US)

(73) Assignee: LG Chem, Ltd. (KR)

( * ) Notice: Subject to any disclaimer, the term of this patent is extended or adjusted under 35 U.S.C. 154(b) by 253 days.

(21) Appl. No.: 12/618,822

(22) Filed: Nov. 16, 2009

(65) Prior Publication Data

US 2010/0271168 A1 Oct. 28, 2010

Related U.S. Application Data

(60) Provisional application No. 61/171,770, filed on Apr. 22, 2009.

(51) Int. Cl.

| | |
|---|---|
| ***H01H 85/50*** | (2006.01) |
| ***H01H 85/20*** | (2006.01) |
| ***H01H 85/25*** | (2006.01) |
| ***H01R 13/62*** | (2006.01) |

(52) U.S. Cl. ..... 337/205; 337/187; 337/194; 361/835; 361/837

(58) Field of Classification Search ..... 337/205, 337/255, 187, 194; 361/835, 837
See application file for complete search history.

(56) References Cited

U.S. PATENT DOCUMENTS

| | | | | |
|---|---|---|---|---|
| 1,966,716 | A * | 7/1934 | Green | 337/194 |
| D298,123 | S * | 10/1988 | Beard | D13/161 |
| 4,951,385 | A | 8/1990 | DeSanto | |
| 4,966,561 | A * | 10/1990 | Norden | 439/620.34 |
| 5,382,480 | A | 1/1995 | Molyneux | |
| 5,831,228 | A * | 11/1998 | Kuki et al. | 200/16 E |
| 5,841,337 | A * | 11/1998 | Douglass | 337/198 |
| 5,842,560 | A * | 12/1998 | Kuki et al. | 200/43.05 |
| 5,847,338 | A * | 12/1998 | Kuki et al. | 200/17 R |
| 5,850,909 | A | 12/1998 | Wagner | |
| 5,854,580 | A | 12/1998 | Konda et al. | |
| 6,054,915 | A * | 4/2000 | Rowton et al. | 337/216 |
| 6,081,049 | A | 6/2000 | Simmons | |
| 6,157,287 | A * | 12/2000 | Douglass et al. | 337/198 |
| 6,333,845 | B1 * | 12/2001 | Hashizawa et al. | 361/642 |
| 6,333,846 | B1 | 12/2001 | Hashizawa et al. | |
| 6,366,449 | B1 * | 4/2002 | Hashizawa et al. | 361/642 |
| 6,407,656 | B1 * | 6/2002 | Konda et al. | 337/194 |
| 6,456,187 | B2 * | 9/2002 | Konda et al. | 337/194 |
| 6,459,353 | B1 * | 10/2002 | Mattlar et al. | 337/9 |
| 6,459,354 | B2 * | 10/2002 | Konda et al. | 337/9 |
| 6,459,558 | B1 | 10/2002 | Hashizawa et al. | |

(Continued)

FOREIGN PATENT DOCUMENTS

EP 1089373 A1 4/2001

(Continued)

OTHER PUBLICATIONS

International Search Report for International application No. PCT/KR2009/003438 dated Jan. 22, 2010.

(Continued)

*Primary Examiner* — Anatoly Vortman
(74) *Attorney, Agent, or Firm* — Cantor Colburn LLP

(57) ABSTRACT

A high voltage service disconnect assembly is provided. The high voltage service disconnect assembly is configured to fixedly hold a plurality of different sized fuses therein having different current rating capabilities, one fuse at a time.

9 Claims, 9 Drawing Sheets

U.S. PATENT DOCUMENTS

| | | | | |
|---|---|---|---|---|
| 6,531,948 | B1 * | 3/2003 | Mennell | 337/211 |
| 6,587,028 | B2 * | 7/2003 | Mollet et al. | 337/194 |
| 6,784,783 | B2 * | 8/2004 | Scoggin et al. | 337/194 |
| 6,853,289 | B2 * | 2/2005 | Scoggin | 337/194 |
| 7,077,704 | B2 | 7/2006 | Ikeda et al. | |
| 7,091,878 | B2 | 8/2006 | Holle et al. | |
| 7,270,576 | B2 | 9/2007 | Kim et al. | |
| 7,294,020 | B2 | 11/2007 | Zhao et al. | |
| 7,355,503 | B2 * | 4/2008 | Buettner | 337/211 |
| 7,362,232 | B2 | 4/2008 | Holle et al. | |
| 7,545,135 | B2 | 6/2009 | Holle et al. | |
| 7,563,137 | B1 | 7/2009 | Koetting et al. | |
| 7,578,702 | B1 | 8/2009 | Tom et al. | |
| 7,750,789 | B2 * | 7/2010 | Titokis et al. | 337/194 |
| 7,893,809 | B2 * | 2/2011 | Head | 337/194 |
| 7,932,804 | B2 * | 4/2011 | Buettner | 337/196 |
| 7,948,353 | B2 * | 5/2011 | Deno et al. | 337/205 |
| 7,982,578 | B2 * | 7/2011 | Buettner | 337/196 |
| 2003/0213121 | A1 | 11/2003 | Rouilolard et al. | |
| 2005/0098419 | A1 * | 5/2005 | Matsui et al. | 200/311 |
| 2005/0130033 | A1 | 6/2005 | Iwamura et al. | |
| 2006/0194101 | A1 | 8/2006 | Ha et al. | |
| 2006/0324558 | | 10/2006 | Li | |
| 2007/0238018 | A1 | 10/2007 | Lee et al. | |
| 2008/0124617 | A1 | 5/2008 | Bjork | |
| 2008/0242150 | A1 * | 10/2008 | Chikamatsu et al. | 439/620.3 |
| 2009/0033453 | A1 | 2/2009 | Deno et al. | |
| 2009/0323293 | A1 | 12/2009 | Koetting et al. | |
| 2009/0325042 | A1 | 12/2009 | Koetting et al. | |

FOREIGN PATENT DOCUMENTS

| | | | | |
|---|---|---|---|---|
| JP | 2007103238 | A | | 4/2007 |
| JP | 2007250386 | A | * | 9/2007 |
| KR | 20080027504 | A | | 3/2008 |
| WO | WO00/30190 | A1 | | 5/2000 |

OTHER PUBLICATIONS

International Search Report for International application No. PCT/KR2009/003440 dated Jan. 22, 2010.

International Search Report for International application No. PCT/KR2010/002332 dated Oct. 29, 2010.

* cited by examiner

HIGH VOLTAGE SERVICE DISCONNECT ASSEMBLY

CROSS-REFERENCE TO RELATED APPLICATIONS

This application claims priority to U.S. Provisional patent application No. 61/171,770, filed on Apr. 22, 2009, the entire contents of which are hereby incorporated by reference herein.

TECHNICAL FIELD

This application relates to a high voltage service disconnect assembly.

BACKGROUND OF THE INVENTION

High current battery modules are utilized in electric vehicles. The inventors herein have recognized that a service disconnect assembly can be utilized to create open circuit in a circuit containing a high current battery modules which would allow a person to safely interact with the battery modules. Further, the inventors herein have recognized that a service disconnect assembly that can hold multiple sized fuses therein would reduce design costs and simplify manufacturing. Further, the inventors herein have recognized that a service disconnect assembly that prevents water and other liquids from entering the service disconnect assembly would be desirable.

SUMMARY OF THE INVENTION

A high voltage service disconnect assembly in accordance with an exemplary embodiment is provided. The high voltage service disconnect assembly includes a first housing assembly having a first housing defining a first interior region, first and second fastener holders, first and second slidable fasteners, and first and second power tabs. The first and second fastener holders are disposed in the first interior region of the first housing and fixedly coupled to the first housing. The first and second fastener holders are configured to receive portions of the first and second slidable fasteners, respectively, therein such that the first and second slidable fasteners can move within the first and second fastener holders, respectively, along a longitudinal axis extending through the first and second fastener holders, respectively, and other portions of the first and second slidable fasteners are configured to be coupled to first and second electrical terminals, respectively, of a fuse, and the first and second power tabs, respectively. The high voltage service disconnect assembly further includes a second housing assembly having a second housing and first and second tab receptacles coupled to the second housing. The second housing is configured to be coupled to the first housing. The first and second tab receptacles are configured to be removably coupled to the first and second power tabs, respectively, such that electrical current can flow through the first tab receptacle, the first power tab, the fuse, the second power tab, and the second tab receptacle.

DETAILED DESCRIPTION OF EXEMPLARY EMBODIMENTS

Figure 1:
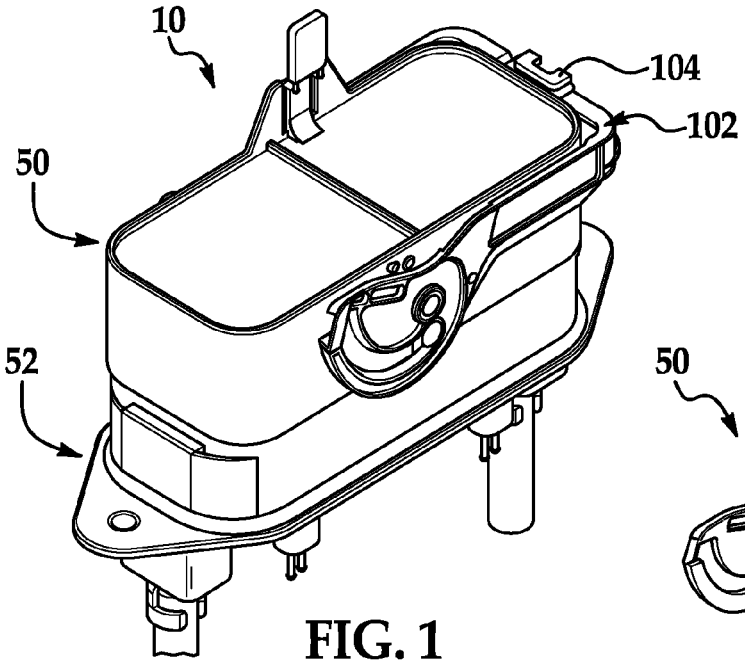
FIG. 1 is a schematic of a high voltage service disconnect assembly having first and second housing assemblies in accordance with an exemplary embodiment.

Referring to FIGS. 1-22, a high voltage service disconnect assembly 10 in accordance with an exemplary embodiment is illustrated. The high voltage service disconnect assembly 10 includes a first housing assembly 50 and a second housing assembly 52 configured to be coupled to the assembly 50. The high voltage service disconnect assembly 10 is configured to allow a user to obtain an open circuit in a voltage circuit 20 when desired. In particular, an open circuit in the circuit 20 can be obtained by physically decoupling the first housing assembly 50 from the second housing assembly 52. An advantage of the assembly 10 is that the assembly 10 can fixedly hold a plurality of different sized fuses therein having different current rating capabilities, one fuse at a time. Further, another advantage of the assembly 10 is that the assembly 10 is sealed to prevent liquids from entering an interior region thereof.

Referring to FIGS. 1-8, the first housing assembly 50 includes a housing 100, a lever 102, a connector position assurance member 104, fastener holders 112, 114, slidable fasteners or coupling members 120, 122, power tabs 130, 132, bus bars 134, 136, a fuse 150, washers 160, 162, nuts 164, 166, and a sealing member or gasket 170. In one exemplary embodiment, the housing 100 is constructed of plastic and defines an interior region 101. The fastener holders 112, 114 are disposed in the interior region 101 of the housing 100 and are fixedly coupled to the housing 100. The fastener holders 112, 114 are configured to receive portions of the slidable fasteners 120, 122, respectively, therein such that the slidable fasteners 120, 122 can move within the fastener holders 112, 114, respectively, along a range of longitudinal positions on the longitudinal axis 171 extending through the fastener holders 112, 114, respectively. Further, other portions of the slidable fasteners 120, 122 are configured to be coupled to first and second terminals, respectively, of the fuse 150, and the power tabs 130, 132, respectively. By allowing a user to adjust longitudinal positions of the slidable fasteners 120, 122 relative to one another, power tabs 130, 132 coupled to the slidable fasteners 120, 122, respectively, can be further coupled to fuses having different current rating capabilities and/or different longitudinal lengths, as will be explained in greater detail below.

Referring to FIGS. 3, 17, 18 and 20, in one exemplary embodiment, the slidable fastener 120 includes a head portion or plate portion 210 and a shaft portion 212 coupled to the head portion 210. The shaft portion 212 is threaded to receive the nut 164 thereon. In one exemplary embodiment, the head portion 210 is substantially square shaped and has a width that is greater than a width "W" of the interior open region 194. Thus, when the shaft portion 212 is disposed through the inner open region 194 of the fastener holder 112, the head portion 210 can be held against the bottom inner walls 190, 192 of the fastener holder 112. Further, the slidable fastener 120 is moved along a longitudinal axis 171, by a user or an assembly device, for being coupled to different sized fuses in the housing 100.

Figure 17:
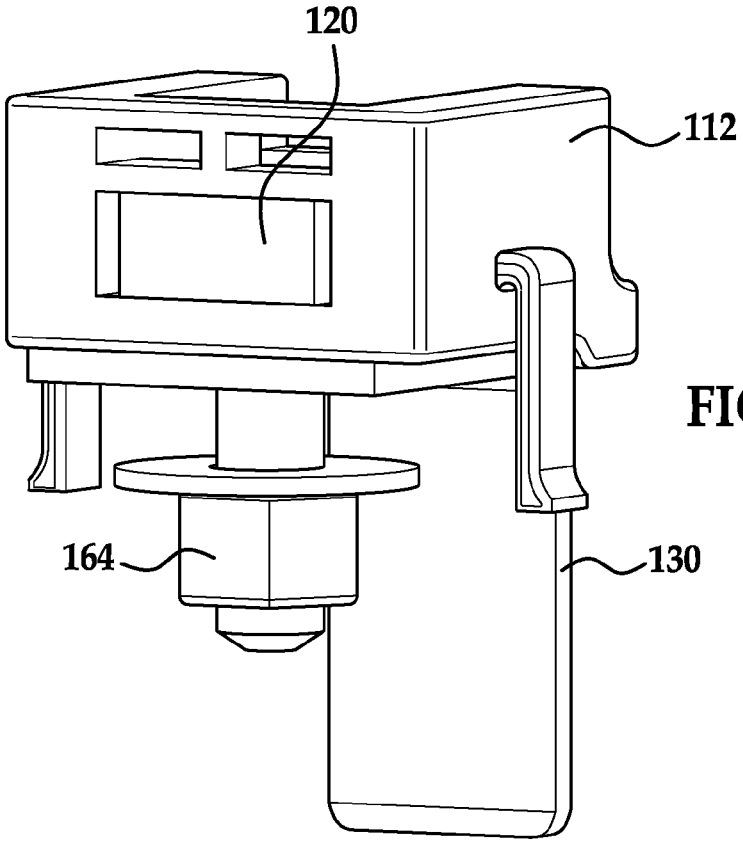
FIG. 17 is an enlarged schematic of a fastener holder, a slidable fastener, a washer, and a nut utilized in the first housing assembly of FIG. 2.
Figure 20:
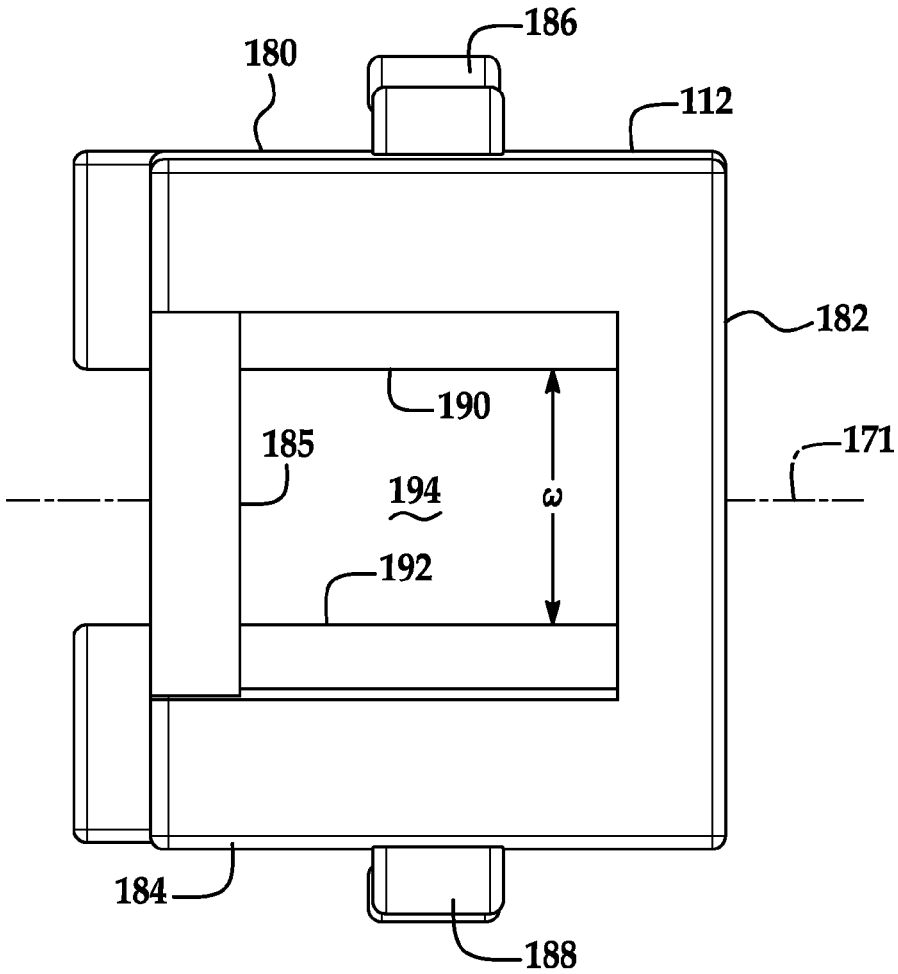
FIG. 20 is a schematic of a top view of the tab member of FIG. 19.
Figure 21:
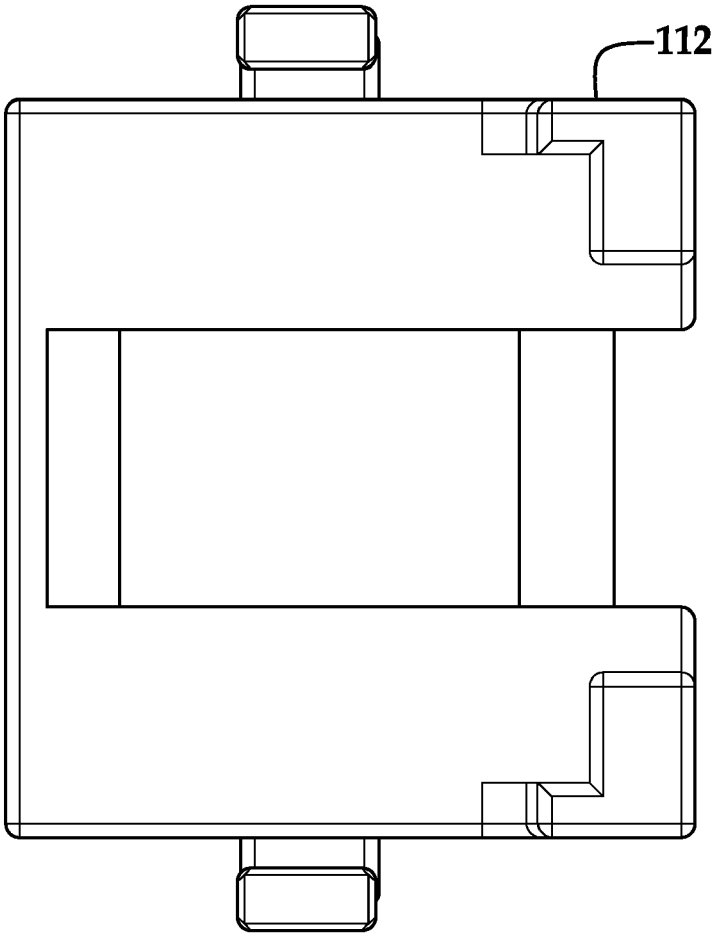
FIG. 21 is a schematic of a bottom view of the tab member of FIG. 19.

Referring to FIGS. 17, 20, and 21, the fastener holder 112 is configured to hold the head portion 210 of the slidable fastener 120 therein and to allow the slidable fastener 120 to be moved longitudinally such at the slidable fastener 120 can be coupled to an electrical terminal of the fuse 150. The fastener holder 114 has an identical structure as the fastener holder 112. The fastener holder 112 includes outer side walls 180, 182, 184, 185. The walls 180, 184 are disposed parallel to one another and the walls 182, 185 are disposed parallel to one another and are coupled between the walls 180, 184. The bottom inner wall 190 is coupled to the outer wall 180, and the bottom inner wall 192 is coupled to the outer wall 184. The bottom inner wall 190, the outer wall 182, the bottom inner wall 192, and the outer wall 185 define an open region 194 for receiving the shaft portion 212 of the slidable fastener 120 therethrough. The securing legs 186, 188 extend downwardly from the outer side walls 180, 184, respectively, and are provided to position and hold the fastener holder 112 within the assembly 10.

Figure 2:
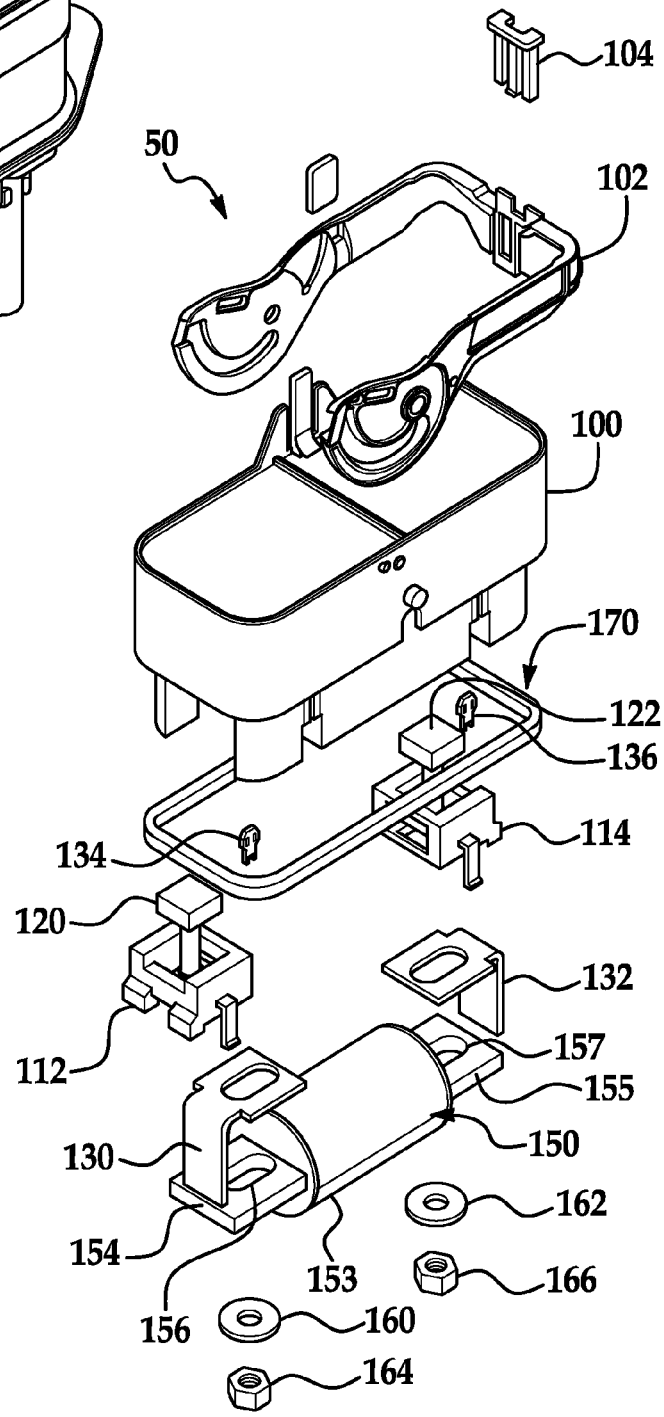
FIG. 2 is an exploded schematic of the first housing assembly utilized in the high voltage service disconnect assembly of FIG. 1.

Referring to FIG. 2, in one exemplary embodiment, the fuse 150 has a body portion 153 and electrical terminals 154, 155 coupled to opposite ends of the body portion 153. The electrical terminals 154, 155 have apertures 156, 157, respectively, extending therethrough. The fuse 150 is a normally-closed fuse that opens when an electrical current flowing therethrough is greater than a threshold current level to prevent current flow therethrough. Of course, other fuse types known to those skilled in the art are contemplated for use in the assembly 10.

Figure 4:
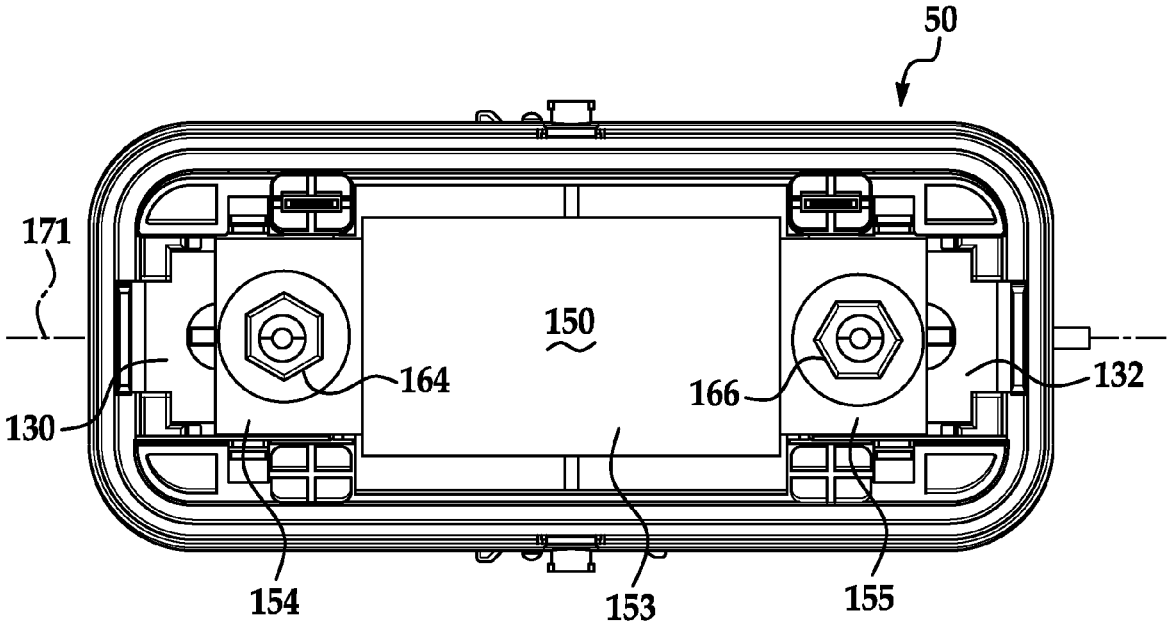
FIG. 4 is a schematic of an interior region of the first housing assembly of FIG. 2 having a first fuse with a first current rating capability therein.
Figure 5:
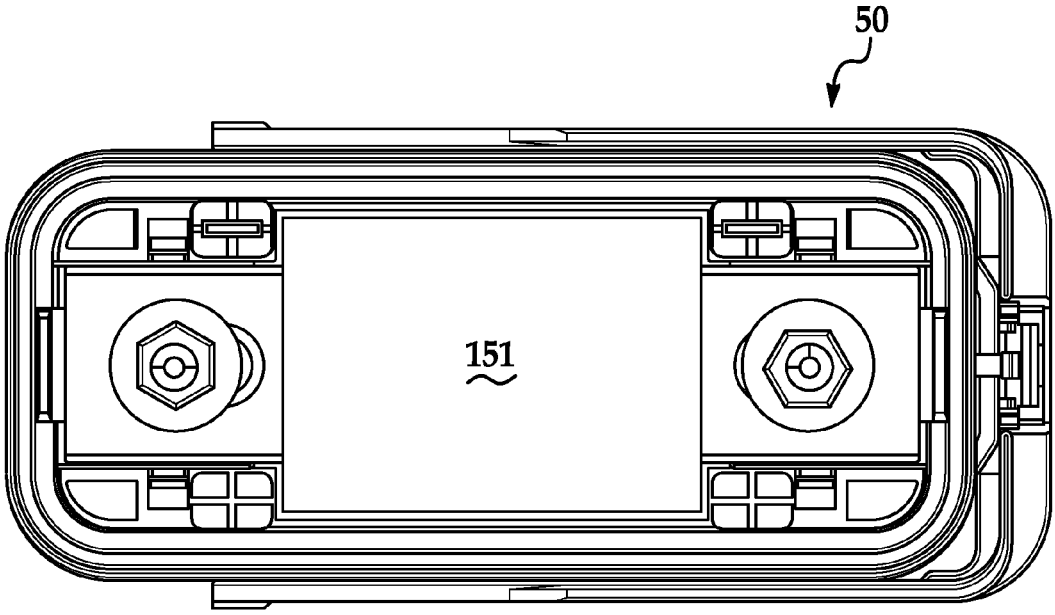
FIG. 5 is a schematic of an interior region of the first housing assembly of FIG. 2 having a second fuse with a second current rating capability therein.
Figure 6:
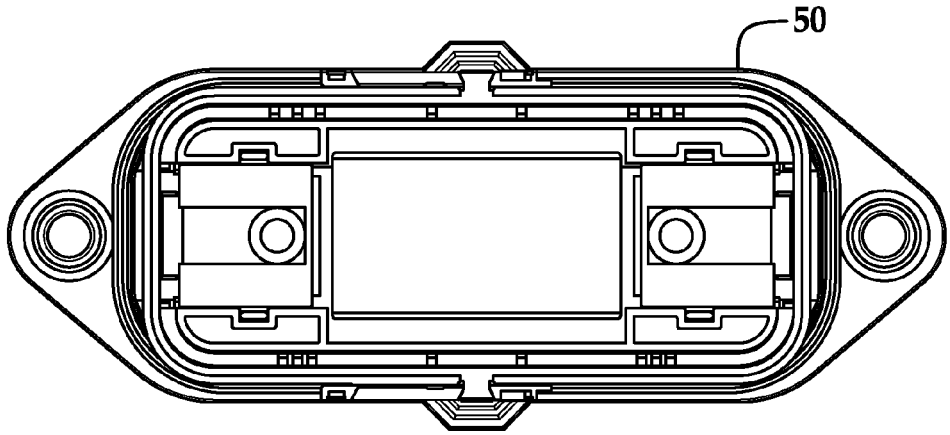
FIG. 6 is a schematic of an interior region of the first housing assembly of FIG. 2 having a third fuse with a third current rating capability therein.
Figure 7:
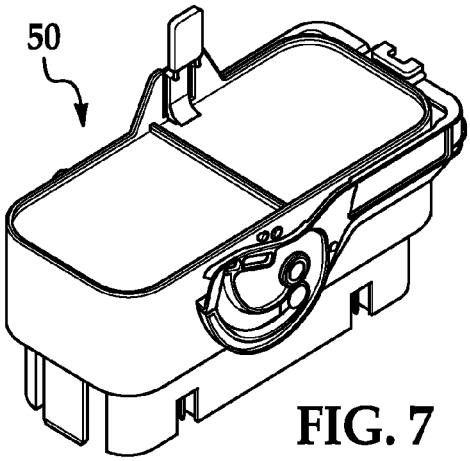
FIG. 7 is another schematic of the first housing assembly of FIG. 2.
Figure 8:
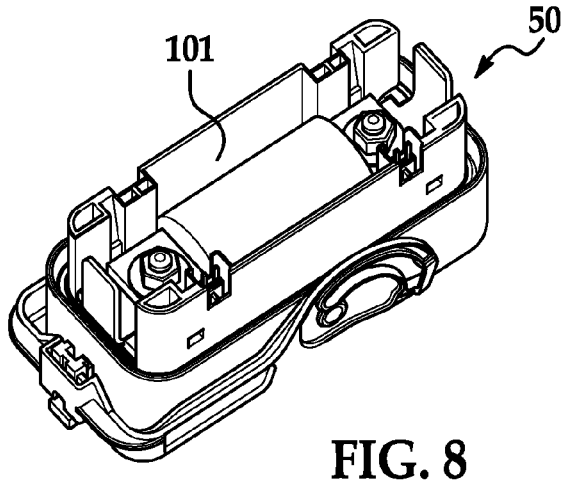
FIG. 8 is another schematic of the first housing assembly of FIG. 2.

By utilizing the fastener holders 112, 114 in the first housing assembly 50, a longitudinal distance between the slidable fasteners 120, 122 is varied by longitudinally moving the slidable fasteners 120, 122 within the fastener holders 112, 114, respectively. Referring to FIG. 4, in particular, the slidable fasteners 120, 122 can be moved to first and second longitudinal positions within the fastener holders 112, 114, respectively, to allow the slidable fasteners 120, 122 to be attached to the first and second terminals 154, 155 of the fuse 150. Further, the fuse 150 has a first current rating capability. In one exemplary embodiment, the first current rating capability is in a range of 100-400 Amps, of course, higher or lower current rating capabilities are contemplated. Referring to FIG. 5, in particular, the slidable fasteners 120, 122 can be moved to third and fourth longitudinal positions within the fastener holders 112, 114, respectively, to allow the slidable fasteners 120, 122 to be attached to third and fourth terminals of another fuse 151. The fuse 151 has a second current rating capability greater than the first current rating capability of the fuse 150. Further, the fuse 151 has a different longitudinal length than the fuse 150. Thus, the assembly 10 can hold fuses having different current rating capabilities and/or different longitudinal lengths.

Figure 18:
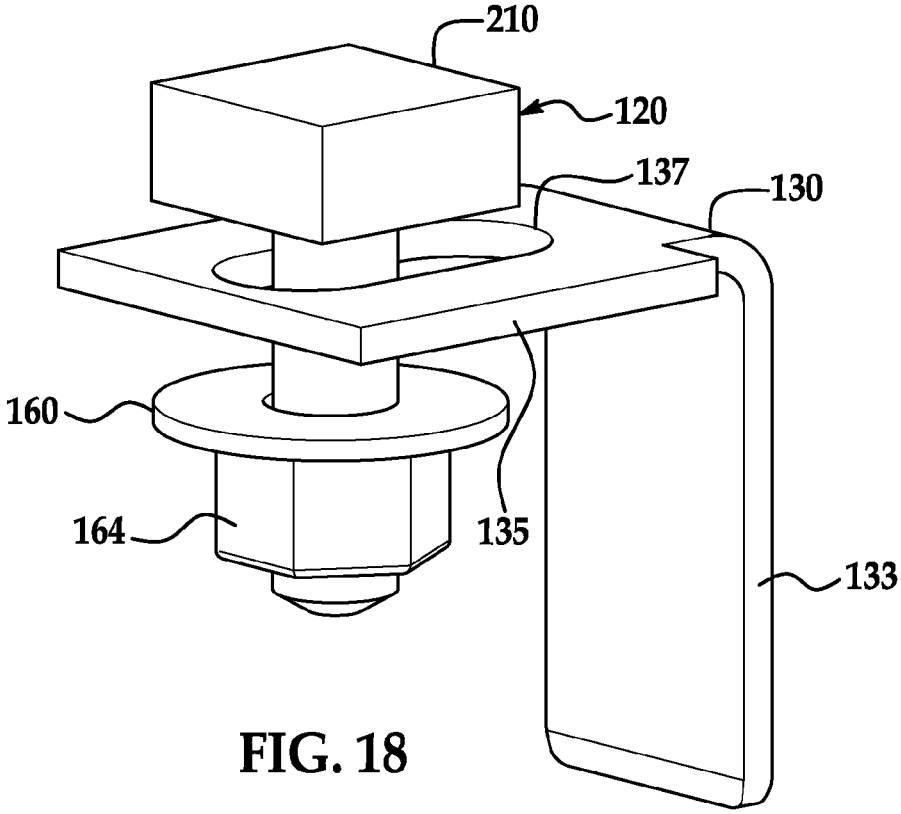
FIG. 18 is an enlarged schematic of a slidable fastener, a washer, and a nut utilized in the first housing assembly of FIG. 2.
Figure 19:
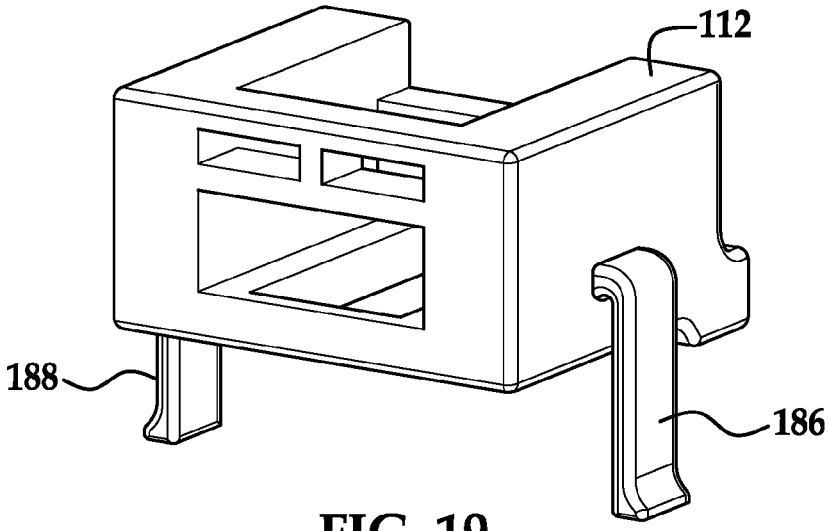
FIG. 19 is an enlarged schematic of a tab member utilized in the first housing assembly of FIG. 2.

Referring to FIGS. 4 and 18, the nuts 164, 166 are configured to receive the threaded shaft portions of the slidable fasteners 120, 122, respectively, therein for fixedly coupling the power tabs 130, 132, respectively, to the first and second terminals 154, 155, respectively, of the fuse 150.

Figure 3:
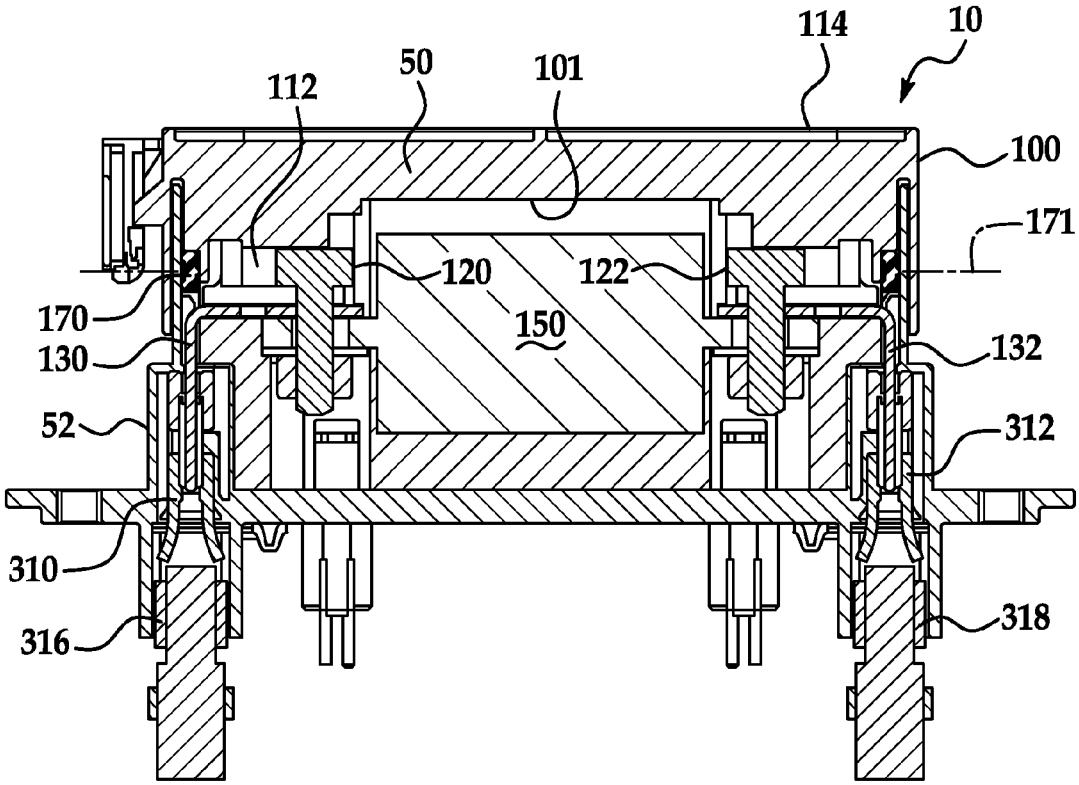
FIG. 3 is a cross-sectional schematic of the high voltage service disconnect assembly of FIG. 1.

Referring to FIGS. 3 and 18, the power tabs 130, 132 are provided to removably electrically connect the first and second terminals 154, 155, respectively, of the fuse 150 to the tab receptacles 310, 312 of the second housing assembly 52. Since the structure of the power tabs 130, 132 are identical to one another, only the structure of the power tab 130 will be described in further detail below. In one exemplary embodiment, the power tab 130 is an L-shaped bracket constructed from metal. In particular, the power tab 130 has a plate portion 133 coupled to a plate portion 135 that is disposed perpendicular to the plate portion 133. The plate portion 135 has an aperture 137 extending therethrough for receiving the shaft portion 212 of the slidable fastener 120 therethrough.

Figure 9:
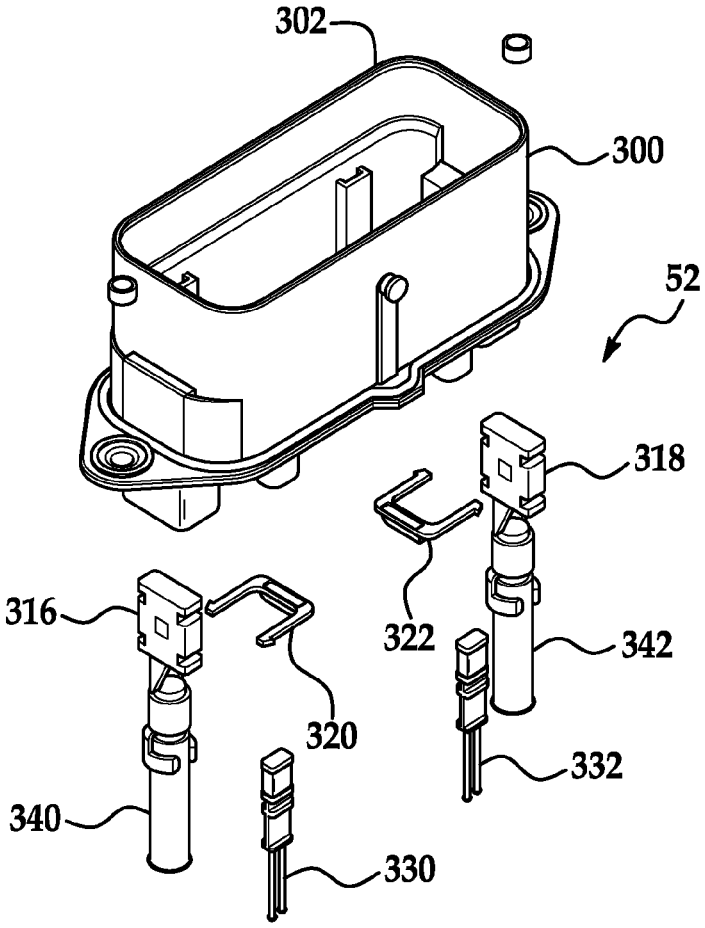
FIG. 9 is an exploded schematic of the second housing assembly utilized in the high voltage service disconnect assembly of FIG. 1.
Figure 10:
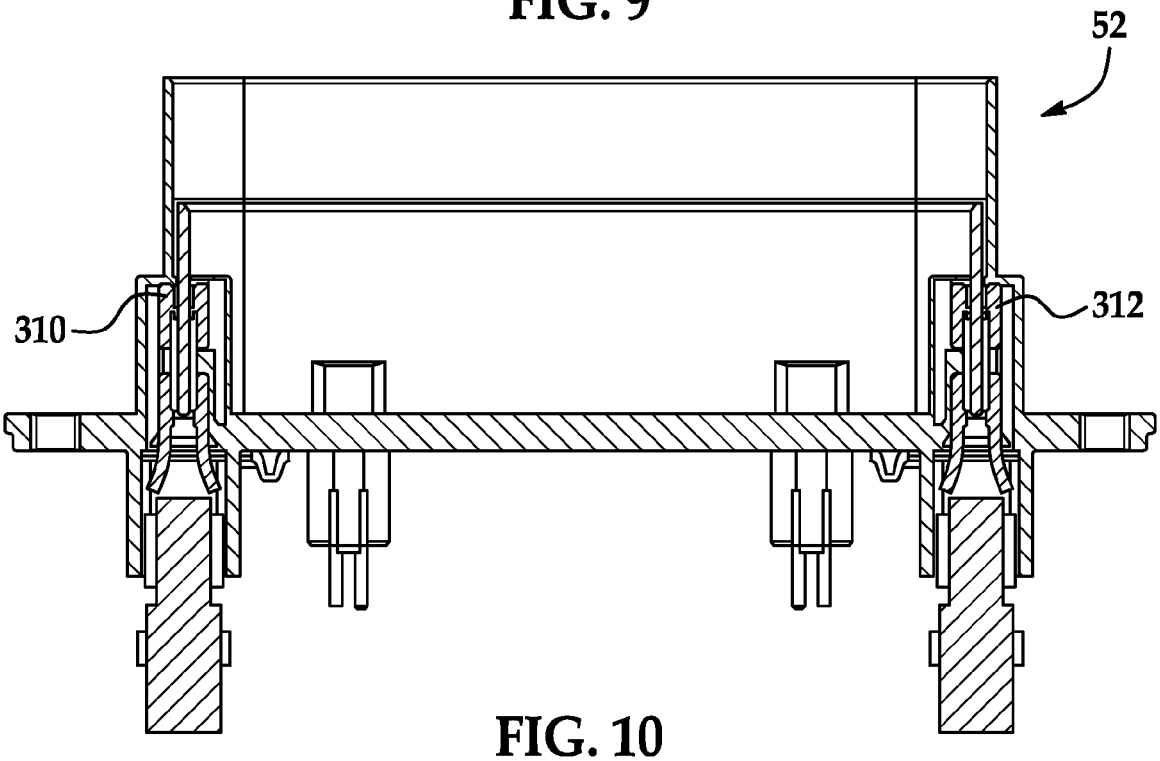
FIG. 10 is a cross-sectional view of the second housing assembly utilized in the high voltage service disconnect assembly of FIG. 1.
Figure 11:
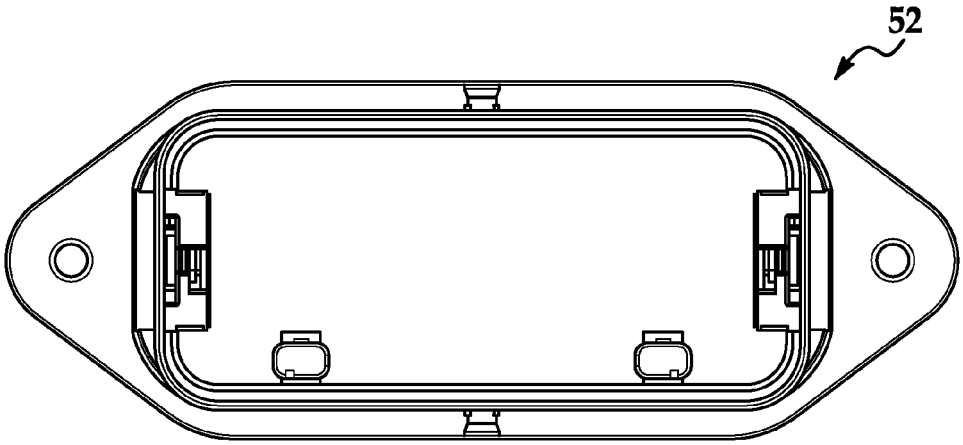
FIG. 11 is another schematic of the second housing assembly of FIG. 10.
Figure 12:
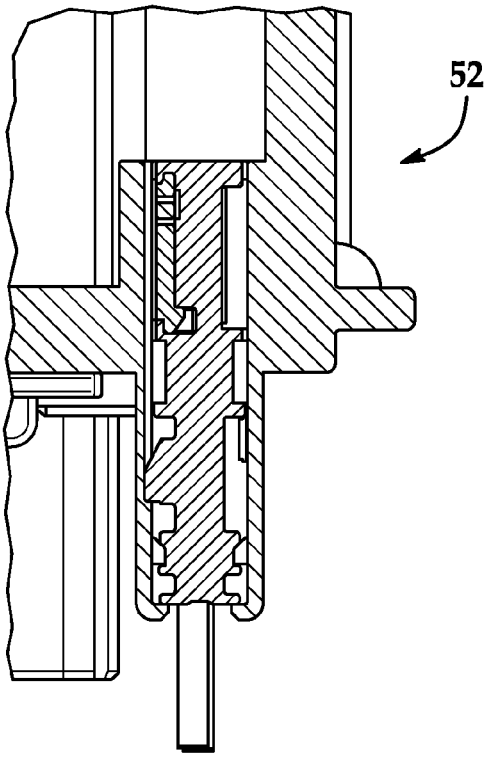
FIG. 12 is a schematic of a portion of the second housing assembly of FIG. 10 illustrating a structure of a tab receptacle utilized therein.
Figure 13:
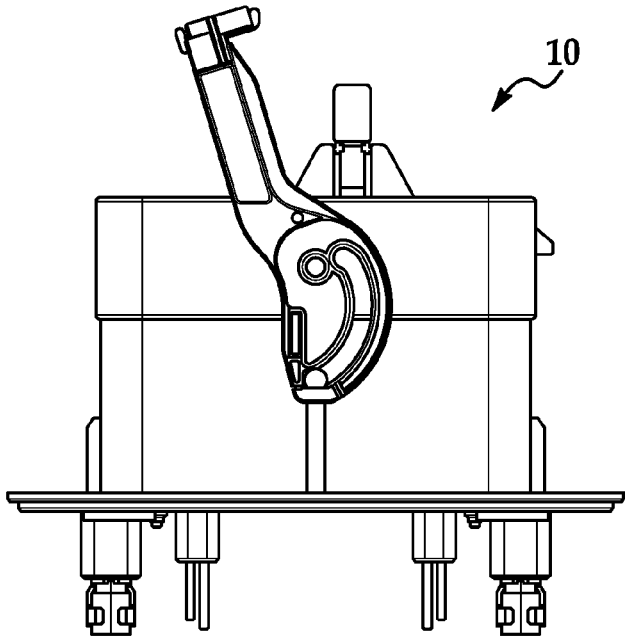
FIG. 13 is a schematic of a side view of the high voltage service disconnect assembly of FIG. 1.
Figure 14:
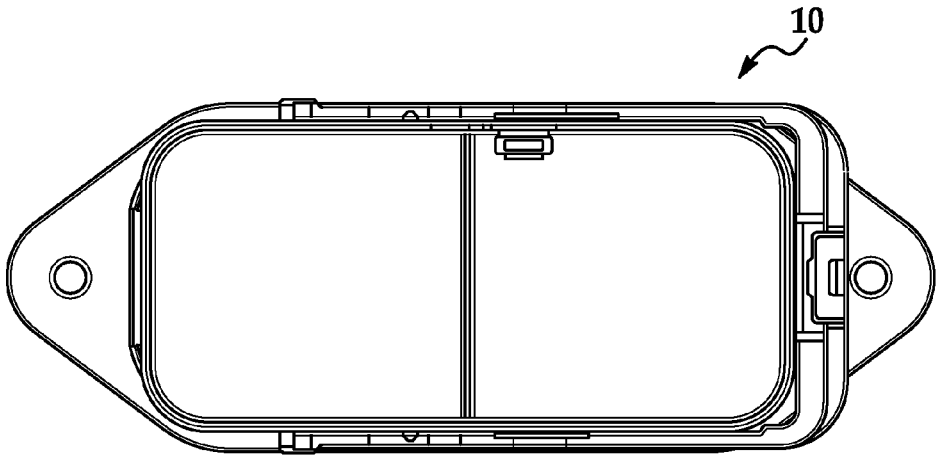
FIG. 14 is a schematic of a top view of the high voltage service disconnect of assembly of FIG. 1.
Figure 15:
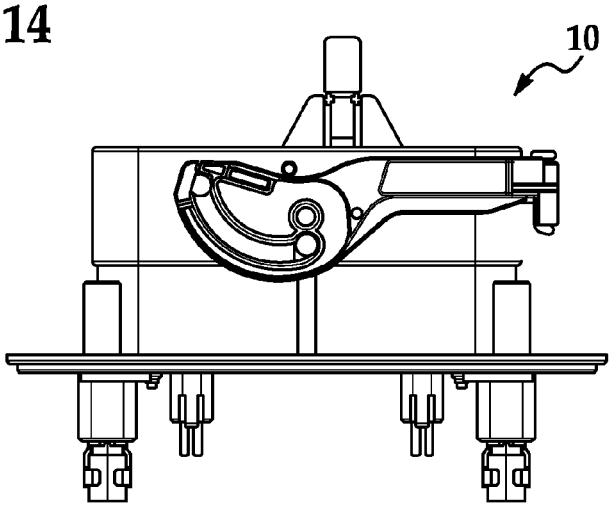
FIG. 15 is another schematic of a side view of the high voltage service disconnect assembly of FIG. 1.
Figure 16:
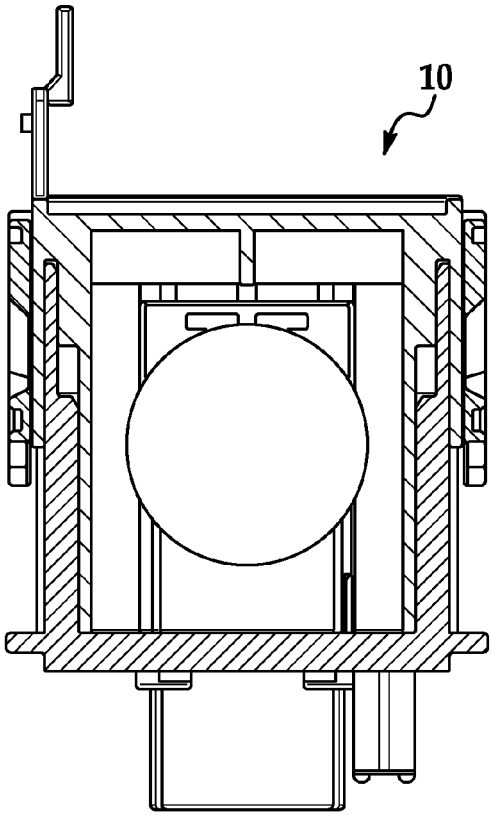
FIG. 16 is a schematic of an end view of the high voltage service disconnect assembly of FIG. 1 indicating a position of a fuse therein.
Figure 22:
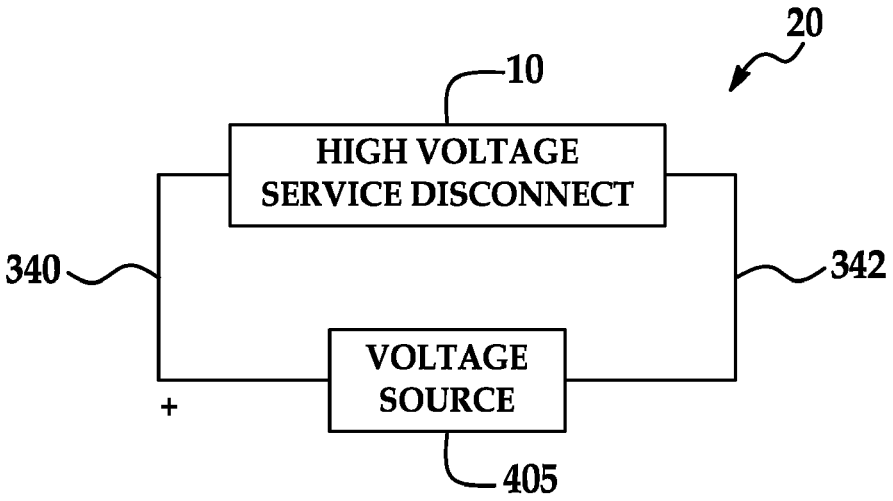
FIG. 22 is a schematic of a circuit having the high voltage service disconnect assembly of FIG. 1 therein and a voltage source.

Referring to FIGS. 9-15, the second housing assembly 52 is configured to be removably coupled to the first housing assembly 50. The second housing assembly 52 includes a housing 300, tab receptacles 310, 312, power terminals 316, 318, secondary locks 320, 322, high voltage interlock members 330, 332, and power cables 340, 342. The tab receptacles 310, 312 are coupled to the housing 300. In one exemplary embodiment, the housing 300 is constructed from plastic. The tab receptacles 310, 312 are configured to be the removably coupled to the power tabs 130, 132, respectively, such that an electrical current can flow through the tab receptacle 310, the power tab 130, the fuse 150, the power tab 132, and the tab receptacle 312. Referring to FIGS. 3, 9, and 22, the power terminals 316, 318 are removably electrically coupled to the tab receptacles 310, 312, respectively. Further, the power terminals 316, 318 are electrically coupled to the power cables 340, 342, respectively. Referring to FIG. 3, the sealing member or sealing gasket 170 of the first housing assembly 50 is configured to contact both the housings 100, 300 when the housings 100, 300 are coupled together to prevent liquids from entering the interior region 101 of the first housing assembly 50.

Referring to FIG. 22, the electrical circuit 20 has the high voltage service disconnect assembly 10 electrically coupled in series with a voltage source 405 is illustrated. The high voltage service disconnect assembly 10 has an open operational condition, when the first housing assembly 50 is decoupled from the second housing assembly 52 such that the power tabs 130, 132 are decoupled from the tab receptacles 310, 312, respectively, wherein an electrical current does not flow through the circuit 20. Further, the high voltage service disconnect assembly 10 has a closed operational condition, when the first housing assembly 50 is coupled with the second housing assembly 52 such that the power tabs 130, 132 are coupled to the tab receptacles 310, 312, respectively, and the fuse 150 has an electrically closed operational condition, wherein an electrical current flows through the circuit 20.

As discussed above, the high voltage service disconnect assembly 10 includes two major assemblies, the first housing assembly 50 and the second housing assembly 52. The second housing assembly 52 is the bottom half of the assembly 10 and includes a basic plug shape that accepts the first housing assembly 50 thereon. Also included in the second housing assembly 52 are two female receptacle connectors that will mate with the male tab blades in the assembly 50. The two female receptacle connectors are molded into the second housing assembly 52 and also route the power cables to the underside of the assembly 10. Another embodiment of the design could include connection points for additional inputs, such as a high voltage interlock (HVIL) or function monitoring. Depending on application, this base could be sealed with a perimeter gasket to prevent contamination and shocking hazards from dust and liquids. Also molded into the second housing assembly 52 are two bosses that are used by the assembly 50 for guide points for a sliding handle assembly. There are holes for mounting the entire assembly 10 to a battery system using fasteners.

Further, the first housing assembly 50 includes a handle with an integrated fuse. In one exemplary embodiment, the assembly 50 is sized to accept a largest available fuse that pertains to a batteries specific use. There is also a connector position assurance (CPA) clip on the handle that must be disengaged before the handle can be moved from the locked position. On the sides are molded in pivot bosses for the handle lever and detent features to lock the lever in place when it is in the fully opened position. A thumb releasable lever is molded to the main connector body to act as a stop feature when the handle is pulled to a certain position and prevents the handle from being pulled past a designated point until the thumb lever is moved by the user. This feature aids in maintaining a five-second minimum disconnection time so to prevent the end user from removing the assembly 50 from the assembly 52 before a storage system deactivates associated contactors. This is also a safety feature to prevent the end user from unintentionally removing the assembly 50 from the assembly 52 before a monitoring system can de-energize the contactors in an electrical circuit.

The assembly 50 includes a fuse, power tabs, and fastener holders. The two male power tabs are bent so they mate with the female connectors in the assembly 52. These tabs are a formed from a metallic conductor material. The tabs are bent so that they form a 90 degree part and have a slotted opening so in addition to sliding into position on the fastener holder piece, it allows a fastener to secure the tabs to the fastener holder assembly. Further, the slotted tabs also allow the bolt to slide perpendicularly to the flat tabs and can be adjusted to accept fuses of varying sizes. The fastener holder is designed so that it snaps into place on the underside of the connector assembly and would be made of a material similar to that used for the connector base. A fuse is then secured in place with the fasteners (e.g., a threaded nut or clip) so that it is seated on the tabs and closes an electrical circuit when the two connector portions are mated on a storage device. Connectors for additional functions (such as HVIL loops, function monitoring) could be molded into the internal portion of the disconnect sub-assembly. A sealing gasket can also be molded into this portion of the connector to protect from dust contamination and liquid intrusion.

It should be noted that in an alternative embodiment, the high voltage service disconnect assembly 10 could hold more than one fuse at a time therein. In this alternative embodiment, two or more fuses could be electrically coupled in series to one another and could be disposed within the interior region 101 of the housing 100. The two or more fuses could be further electrically coupled to the power tabs 130, 132 or to other power tabs known to those skilled in the art.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying this invention, but that the invention will include all embodiments falling within the scope of the appended claims. Moreover, the use of the terms, first, second, etc. are used to distinguish one element from another. Further, the use of the terms a, an, etc. do not denote a limitation of quantity, but rather denote the presence of at least one of the referenced items.

What is claimed is:

1. A high voltage service disconnect assembly, comprising:

a first housing assembly having a first housing defining a first interior region, first and second fastener holders, first and second slidable fasteners, and first and second power tabs, the first and second fastener holders disposed in the first interior region of the first housing and fixedly coupled to the first housing, the first and second fastener holders configured to receive portions of the first and second slidable fasteners, respectively, therein such that the first and second slidable fasteners can move within the first and second fastener holders, respectively, along a longitudinal axis extending through the first and second fastener holders, respectively, and other portions of the first and second slidable fasteners are configured to be coupled to first and second electrical terminals, respectively, of a fuse, and the first and second power tabs, respectively; and a second housing assembly having a second housing and first and second tab receptacles coupled to the second housing, the second housing configured to be coupled to the first housing, the first and second tab receptacles configured to be removably coupled to the first and second power tabs, respectively, such that electrical current can flow through the first tab receptacle, the first power tab, the fuse, the second power tab, and the second tab receptacle.

2. The high voltage service disconnect assembly of claim 1, wherein a longitudinal distance between the first and second slidable fasteners is variable by longitudinally moving the first and second slidable fasteners within the first and second fastener holders, respectively.

3. The high voltage service disconnect assembly of claim 1, wherein the first and second slidable fasteners are configured to be moved to first and second positions within the first and second fastener holders, respectively, to allow the first and second slidable fasteners to be attached to the first and second electrical terminals of the fuse, the fuse having a first current rating capability.

4. The high voltage service disconnect assembly of claim 3, wherein the first current rating capability is 100-400 amps.

5. The high voltage service disconnect assembly of claim 3, wherein the first and second slidable fasteners are configured to be moved to third and fourth positions within the first and second fastener holders, respectively, to allow the first and second slidable fasteners to be attached to third and fourth electrical terminals, respectively, of another fuse, the another fuse having a second current rating capability greater than the first current rating capability.

6. The high voltage service disconnect assembly of claim 1, wherein the first housing is a single piece housing that covers the fuse and includes a first sealing gasket configured to contact both the first and second housings when the first and second housings are coupled together to prevent liquids from entering the first interior region of the first housing assembly.

7. The high voltage service disconnect assembly of claim 1, wherein the portions of the first and second slidable fasteners comprise first and second head portions, respectively, and the other portions of the first and second slidable fasteners comprise first and second shaft portions, respectively, the first and second head portions being coupled to the first and second shaft portions, respectively.

8. The high voltage service disconnect assembly of claim 7, wherein the first and second slidable fasteners further have first and second nuts, respectively, the first and second nuts configured to receive the first and second shaft portions, respectively, of the first and second slidable fasteners, respectively, therein for fixedly coupling the first and second power tabs, respectively, to the first and second electrical terminals, respectively, of the fuse.

9. The high voltage service disconnect assembly of claim 1, wherein the first housing assembly and the second housing assembly are constructed of plastic.

* * * * *